US005473919A

United States Patent [19]

Abner et al.

[11] Patent Number: 5,473,919

[45] Date of Patent: Dec. 12, 1995

[54] MANIPULATION RESISTANT COMBINATION LOCK WITH MAGNETS

[75] Inventors: Roy T. Abner, Lexington; Brian D. Costley, Nicholasville, both of Ky.

[73] Assignee: Sargent & Greenleaf, Inc., Nicholasville, Ky.

[21] Appl. No.: 202,648

[22] Filed: Feb. 28, 1994

[51] Int. Cl.[6] ..... E05B 37/08; E05B 47/00

[52] U.S. Cl. ..... 70/276; 70/303 A; 70/333 R

[58] Field of Search ..... 70/276, 333 R, 70/320–322, 303 R, 303 A, 442, 444

[56] References Cited

U.S. PATENT DOCUMENTS

| | | | |
|---|---|---|---|
| 47,575 | 5/1865 | Sargent et al. | 70/321 |
| 51,973 | 1/1866 | Sargent et al. | 70/322 |
| 57,574 | 8/1866 | Sargent . | |
| 2,925,726 | 2/1960 | Miller . | |
| 3,015,087 | 12/1961 | O'Gorman | 70/276 |
| 3,106,083 | 10/1963 | Maynard . | |
| 3,376,615 | 4/1968 | Heckman | 70/276 |
| 3,906,761 | 9/1975 | Swaim | 70/333 R |
| 3,991,596 | 11/1976 | Gartner | 70/322 X |
| 4,420,955 | 12/1983 | Marold | 70/303 A |
| 4,472,951 | 9/1984 | Morden | 70/25 |
| 4,756,176 | 7/1988 | Uyeda | 70/303 A |
| 4,777,815 | 10/1988 | Lovell et al. | 70/276 |
| 5,307,656 | 5/1994 | Gartner et al. | 70/303 A X |

*Primary Examiner*—Lloyd A. Gall

*Attorney, Agent, or Firm*—Popham, Haik, Schnobrich & Kaufman, Ltd.

[57] ABSTRACT

A manipulation resistant combination lock is shown which has a housing, a drive shaft, a cam driver attached to the drive shaft, a bolt slidable into and out of the housing, a fence lever, a fence attached to the fence lever, and a set of tumbler wheels. A first end of the fence lever is pivotally attached to the bolt, and a second end of the fence lever has a dog which is engagable with a slot in the outer periphery of the cam driver. The cam driver is keyed to the drive shaft and holds two circumferentially spaced permanent magnets, one on each side of the slot. The dog portion of the fence lever also has a permanent magnet mounted thereon. The permanent magnets mounted on the cam driver and on the dog portion of the fence lever are arranged such that opposing magnetic poles generate a repulsive force as the fence lever approaches both sides of the slot in the cam driver. This feature prevents a lock manipulator from detecting the precise location of the cam driver slot and therefore precludes the possibility of detecting the location of gates in the tumbler wheels that would line up with the fence at the point where the cam driver slot lines up with the dog on the fence lever.

14 Claims, 2 Drawing Sheets

MANIPULATION RESISTANT COMBINATION LOCK WITH MAGNETS

BACKGROUND OF THE INVENTION

1. Field of the Invention

The present invention relates to combination locks. More specifically, the invention relates to a combination lock which provides increased manipulation resistance.

2. Related Art

It is common in combination locks, such as that disclosed in the U.S. Pat. No. 4,756,176, which is herein incorporated by reference, to provide a fence lever control device which includes means for normally keeping the nose of the fence lever spaced from the drive cam and only moving the fence lever and its associated nose toward the drive cam when tumbler wheel gates are aligned with one another and are ready to receive the fence member of the fence lever as part of the authorized opening of the lock. These prior art means for keeping the nose of the fence lever spaced from the drive cam were developed in order to prevent a lock manipulator from determining where the drive cam gate is and then manipulating the lock parts in a predetermined manner to bring the fence member in contact with edges of the gates of the wheel assemblies while the lever nose is positioned in the drive cam gate. However, such prior known mechanisms have been fairly complicated to manufacture and are not well adapted to ease of assembly techniques in mass production of combination locks.

U.S. Pat. No. 47,575 to Sargent et al. and U.S. Pat. No. 57,574 to Sargent et al. disclose locks which use a magnet to attract a dog into engagement with notches in permutation wheels when retraction of a bolt is enabled. These locks require a complex apparatus including an armature for activating and deactivating the magnet. The dog is a separate member from a swing-gate that is connected to the bolt and enables retraction of the bolt.

SUMMARY OF THE INVENTION

It is therefore, the primary object of the present invention to disclose and provide a simple yet reliable construction for a manipulation resistant combination lock wherein the lock requires relatively few parts operating in a simple and effective manner but which will not give an unauthorized lock manipulator any "feel" for opening the lock through movement and/or engagement between the fence lever and the gate wheel assemblies and/or the drive cam.

More specifically, the present invention includes permanent magnets mounted on both sides of a drive cam gate, and also on a nose portion of a fence lever which is designed to drop into the drive cam gate when all of the tumbler wheel gates are lined up and positioned to receive a fence member attached to the fence lever. The permanent magnets mounted on both sides of the drive cam gate and on the nose portion of the fence lever are oriented such that a repulsive force is produced when the nose of the fence lever approaches the drive cam gate. The presence of these magnets makes it extremely difficult for a lock manipulator to determine the precise points at which the drive cam gate begins and ends. As a result, a lock manipulator cannot determine the point at which the fence lever drops into the drive cam gate and therefore cannot determine if there are any gates in the tumbler wheels in that area.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
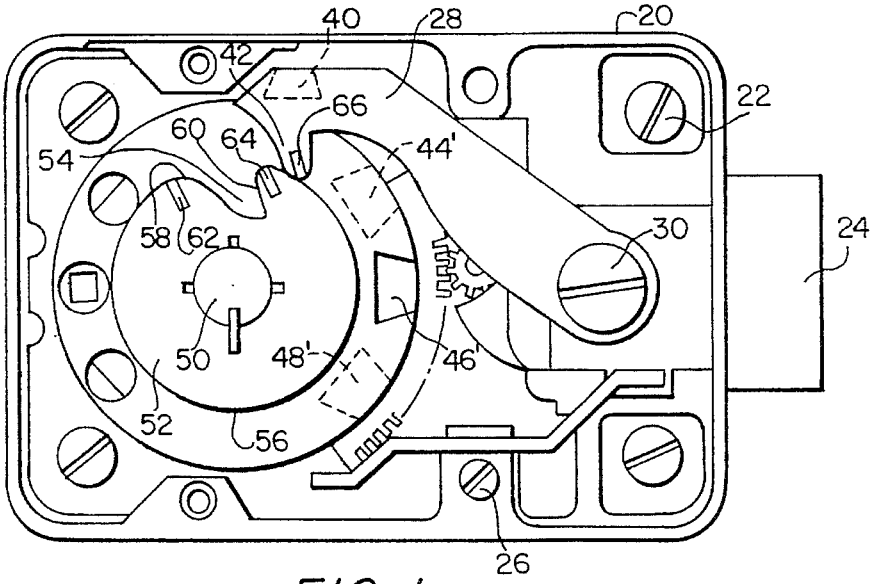
FIG. 1 is a side elevation view, with the cover removed, of the manipulation resistant combination lock with the nose of the fence lever contacting the outer periphery of the drive cam.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring initially to FIG. 1, the exemplary lock includes a housing 20 mounted to the interior of a door (not shown) by appropriate mounting screws 22 in known fashion. The lock includes a bolt 24 which is adapted to be received within a receptacle in a wall (not shown) in conventional manner. A cover (not shown) can be held in place on housing 20 by screws 26.

As shown in FIG. 1, a fence lever 28 is pivotally mounted at one end by a pivot screw 30 secured to bolt 24 and has a fence 40 (shown in phantom in FIG. 2) protruding laterally from an opposite free end of fence lever 28.

Fence 40 is adapted to cooperate in known manner with gates 44', 46' and 48', respectively, of exemplary tumbler wheel assemblies. The tumbler wheel assemblies are generally formed with an inner drive ring manipulated by rotation of drive shaft 50 and have an outer relatively adjustable gate ring as more fully disclosed in U.S. Pat. No. 4,142,388, which is herein incorporated by reference.

Figure 4:
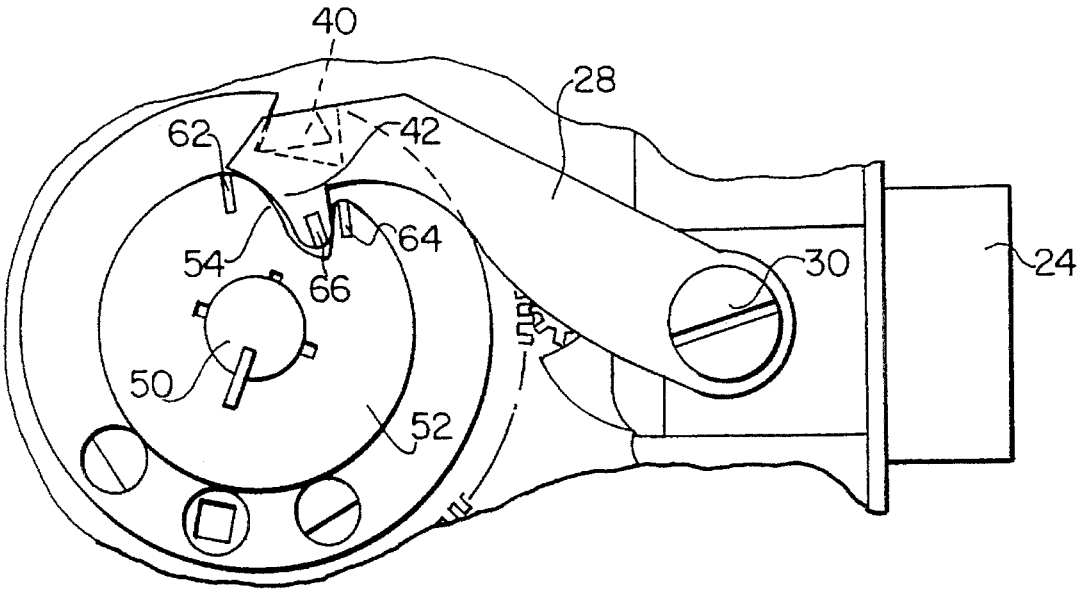
FIG. 4 is a side elevation view similar to FIG. 3 showing the position of the nose of the fence lever immediately after engagement with the drive cam gate and prior to retraction of the bolt.
Figure 5:
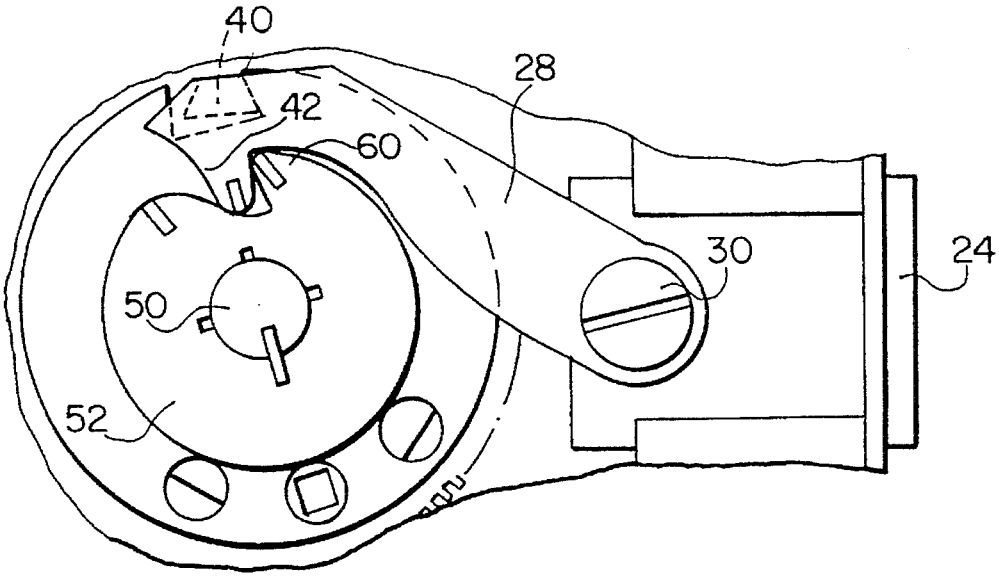
FIG. 5 is a side elevation view similar to FIG. 4 showing the nose of the fence lever in engagement with the drive cam gate and the drive cam rotated to a bolt retracted position.

Drive cam 52 is provided on an inner end of drive shaft 50 and is provided with a cam gate 54 to cooperate with nose portion 42 of fence lever 28 as best seen in FIGS. 4 and 5. When fence lever nose portion 42 is in engagement with cam gate 54, (a condition allowed only when the combination has been correctly dialed and tumbler wheel gates 44', 46' and 48' are aligned so that fence 40 is received in the tumbler wheel gates 44', 46' and 48') further counterclockwise rotation of drive shaft 50 will retract pull bolt 24 to the left out of the wall receptacle to cause unlocking of the combination lock.

It is known that unauthorized entry into combination locks can be achieved by persons skilled in the lock manipulating art by turning the lock dial and its associated drive shaft to hopefully bring portions of the tumbler wheels, and particularly their gates, in contact with the fence. For this reason, fence lever nose portion 42 normally rides on the outer periphery 56 of drive cam 52, thereby holding fence 40 out of contact with tumbler wheel gates 44', 46' and 48', as shown in FIG. 1. However, it has also been found that persons skilled in the lock manipulation art can use even slight indications or "feel" imparted to the dial by fence lever nose portion 42 engaging drive cam gate pushing edge 58 or drive cam gate pulling edge 60 in a lock manipulation procedure. As stated earlier, it is a primary object of the present invention to disclose a simplified, and inexpensive device for controlling movement of fence lever 28 in order to preclude a lock manipulator from feeling the precise location of drive cam gate 54.

As is particularly contemplated within the present invention, drive cam gate pushing edge 58 and drive cam gate pulling edge 60 at the lateral extremities of drive cam gate 54 each have a radially inwardly extending recess into which permanent magnets 62 and 64 are matingly and securely received. Likewise, fence lever nose portion 42 has a recess extending inwardly from its periphery and into which a permanent magnet 66 is matingly and securely received.

Figure 2:
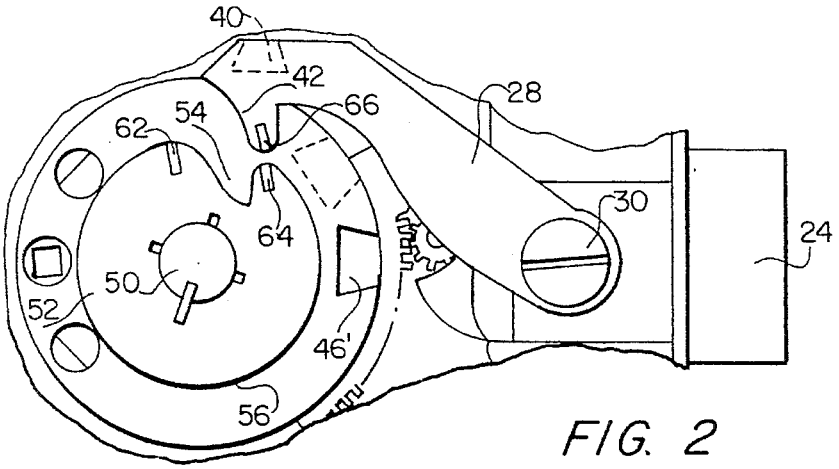
FIG. 2 is a side elevation view similar to FIG. 1 with the nose of the fence lever magnetically repelled from the pulling edge of the drive cam gate.
Figure 3:
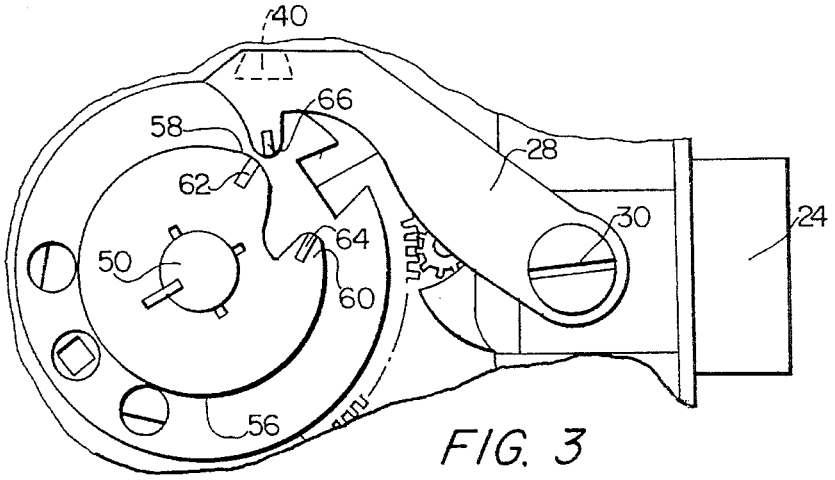
FIG. 3 is a side elevation view similar to FIG. 2 showing the nose of the fence lever magnetically repelled from the pushing edge of the drive cam gate.

Permanent drive cam magnets 62 and 64 and a fence lever magnet 66 are oriented such that when drive cam 52 is rotated by drive shaft 50 towards either of the positions shown in FIGS. 2 and 3, wherein fence lever nose portion 42 approaches either of the lateral extremities of drive cam gate 54, the magnetic axes of the drive cam magnets are approximately aligned with the magnetic axis of fence lever magnet 66 to effect a repulsive magnetic force that causes fence lever nose portion 42 to be urged upwardly in a clockwise direction and to move away from contact with outer periphery 56 of drive cam 52. As a result, it is virtually impossible for a lock manipulator to "feel" the precise location of drive cam gate 54. Therefore, the lock manipulator cannot rotate drive cam 52 in a predetermined manner to bring fence 40 into contact with edges of tumbler wheel gates 44', 46' and 48', while fence lever nose portion 42 is positioned in drive cam gate 54.

When the correct combination is dialed into the combination lock, all of the tumbler wheel gates will be lined up, as shown in FIG. 4, and fence lever 28 will pivot downwardly in counterclockwise manner about pivot screw 30 with fence 40 dropping into the tumbler wheel gates and fence lever nose portion 42 dropping into drive cam gate 54. From this position, rotation of drive cam 52 in a counterclockwise direction by the counterclockwise rotation of the combination lock dial and drive shaft 50, results in drive cam gate pulling edge 60 pushing against fence lever nose portion 42 and retracting bolt 24, as shown in FIG. 5.

Modifications and variations of the above-described embodiments of the present invention are possible, as will be appreciated by those skilled in the art in light of the above teachings.

It is therefore to be understood that, within the scope of the appended claims and their equivalents, the invention may be practiced otherwise than as specifically described.

LIST OF DESIGNATORS

20—housing
22—mounting screws
24—bolt
26—cover screws
28—fence lever
30—pivot screw
40—fence
42—nose portion
44'—tumbler wheel gate
46'—tumbler wheel gate
48'—tumbler wheel gate
50—drive shaft
52—drive cam
54—drive cam gate
56—drive cam periphery
58—drive cam gate pushing edge
60—drive cam gate pulling edge
62—permanent magnet
64—permanent magnet
66—permanent magnet

What is claimed is:

1. In a combination lock having a pivotal fence lever having a nose portion and a rotary drive cam having an outer periphery adjacently facing the fence lever and an inwardly extending drive cam gate, the improvement comprising:

drive cam magnet means mounted on the outer periphery of said drive cam adjacent said drive cam gate;

a fence lever magnet mounted on said nose portion of said fence lever facing the outer periphery of the drive cam for reacting with said drive cam magnet means for repelling said fence lever away from said drive cam during a portion of the rotation of said drive cam.

2. The combination lock of claim 1 wherein:

said drive cam magnet means comprises first and second permanent magnets respectively mounted on the outer periphery of said drive cam adjacent opposite sides of said drive cam gate.

3. The combination lock of claim 2 wherein:

said magnets are permanent magnets with each having a magnetic axis and wherein the drive cam magnets' magnetic axes are sequentially aligned with the magnetic axis of the fence lever magnet during rotation of the drive cam to urge the fence lever away from contact with the periphery of the drive cam in areas adjacent said opposite sides of said drive cam gate.

4. The combination lock of claim 3 wherein:

the magnetic axes of the drive cam magnets are approximately parallel to each other.

5. An improved manipulation resistant combination lock for impeding unauthorized opening of a combination lock through manipulation of the lock components, wherein said lock comprises:

a housing;

a bolt slidably mounted to the housing;

a fence lever moveable about a pivot;

a fence member on said fence lever;

a drive shaft rotatably mounted on said housing;

a drive cam keyed to said drive shaft, said drive cam having an outer periphery;

a plurality of tumbler wheels that are rotated within said housing by said drive shaft with each of said tumbler wheels having respective gates that align with said fence member when said drive shaft is rotated in a predetermined manner;

drive cam magnet means mounted on said drive cam outer periphery; and a fence lever magnet mounted at one end of said fence lever for reacting with said drive cam magnet means for repelling said fence lever away from said drive cam during a portion of the rotation of said drive shaft.

6. The manipulation resistant combination lock of claim 5 wherein:

said drive cam has a drive cam gate recess extending inwardly from its outer periphery, said recess having first and second lateral extremities with said drive cam magnet means comprising first and second drive cam magnets respectively mounted on the outer periphery of said drive cam adjacent said first and second lateral extremities.

7. The manipulation resistant combination lock of claim 6 wherein:

said drive cam magnets and said fence lever magnet are permanent magnets.

8. The manipulation resistant combination lock of claim 6 wherein:

said first and second lateral extremities comprise a drive cam gate pushing edge for engaging said fence lever to rotate said fence lever in a direction causing removal of said fence member from the tumbler wheel gates and a pulling edge engageable with the fence lever for moving the bolt inwardly of the housing.

9. The manipulation resistant combination lock of claim 8 wherein:

said magnets are permanent magnets with each having a magnetic axis and wherein the drive cam magnets' magnetic axes are sequentially aligned with the magnetic axis of the fence lever magnet during rotation of the drive cam to urge the fence lever away from contact with the periphery of the drive cam in areas adjacent said first and second lateral extremities of said drive cam gate recess.

10. The manipulation resistant combination lock of claim 9 wherein:

the magnetic axes of the drive cam magnets are approximately parallel to each other.

11. A method of preventing unauthorized opening of a combination lock of the type having a pivotal fence lever having a nose portion facing the outer periphery of a rotary drive cam having an inwardly extending drive cam gate having first and second side edges extending inwardly from its outer periphery, said method comprising the steps of:

applying force to said pivotal fence lever to urge it away from the periphery of the rotary drive cam in response to rotation of the first side edge into facing relationship with said nose portion; and, similarly, applying force to said pivotal fence lever to urge it away from the periphery of the rotary drive cam in response to the rotation of the second side edge into facing relationship with said nose portion;

said steps of applying force to said pivotal fence lever being effected by the application of magnetic force; and said application of magnetic force being effected by bringing the axes of two magnets into substantial alignment with each other with like poles of each magnet facing each other so that said magnets are repelled from each other.

12. The method of claim 11 wherein:

one of said magnets is mounted for rotation with said drive cam so that such rotation brings said one magnet into substantial alignment with the other magnet.

13. The method of claim 12 wherein the other of said magnets is mounted on the nose portion of the pivotal fence lever.

14. The method of claim 13 wherein said one magnet is mounted on said drive cam.

* * * * *